US005372366A

United States Patent [19]

Gohlke

[11] Patent Number: 5,372,366

[45] Date of Patent: Dec. 13, 1994

[54] METHOD FOR PLAYING A BOARD GAME

[75] Inventor: James M. Gohlke, Las Vegas, Nev.

[73] Assignee: High Stakes Challenge, Inc., Las Vegas, Nev.

[21] Appl. No.: 917,663

[22] Filed: Jul. 29, 1992

Related U.S. Application Data

[63] Continuation of Ser. No. 587,868, Oct. 12, 1990, abandoned.

[51] Int. Cl.[5] ..... A63F 1/00

[52] U.S. Cl. ..... 273/274; 273/243

[58] Field of Search ..... 273/242, 243, 259, 274, 273/277, 292

[56] References Cited

U.S. PATENT DOCUMENTS

| | | | |
|---|---|---|---|
| 3,889,954 | 6/1975 | Malisow | 273/274 X |
| 4,416,454 | 11/1983 | Delamontagne | 273/243 |
| 4,887,819 | 12/1989 | Walker | 273/274 X |
| 4,921,249 | 5/1990 | Kropkowski et al. | 273/274 X |
| 4,930,789 | 6/1990 | Harris et al. | 273/274 X |
| 4,971,561 | 11/1990 | Krane | 273/243 X |

*Primary Examiner*—Vincent Millin
*Assistant Examiner*—William M. Pierce

[57] ABSTRACT

A method for playing a board game is provided using one standard deck of playing cards ranked in order Ace, King, Queen, Jack, 10, 9, 8, 7, 6, 5, 4, 3, 2; or a pocket billiard table with pool balls ranked in order, 1, 2, 3, 4, 5, 6, 7, 8, 9, 10, 11, 12, 13, 14, 15. The game board playing surface comprises the steps for two to ten players taking turns throwing two dice, moving a moving piece the correct number of spaces along the playing path. Depending on the space landed on the player either acts on that space, or draws one of the three draw cards: game, pay or collect. If the player lands on a pay space he must pay the penalty listed. If the player lands on a collect space he must collect the bonus listed. If the player lands on a game space he must play the game listed. He must also follow the correct limits to play for as listed on the game card. When the game card is drawn that player shuffles and deals the cards to all players, or racks the pool balls and breaks to begin the game. The player who obtains the highest ranking card hand wins the money in the pot, or the player that shoots in the winning pool ball wins the money in that game. Once a winner for that game played is determined the dice are passed to the next player to continue playing.

8 Claims, 11 Drawing Sheets

7 Card Razz
Single Stakes
Players-Ante-Limits

2- $500 - $500 - $1000
3- $300 - $300 - $600
4- $200 - $200 - $400
5- $100 - $100 - $200
6- $50 - $50 - $100
7- $25 - $25 - $50
8- $25 - $25 - $50

7 Card Razz
Double Stakes
Players-Ante-Limits

2- $1000-$1000-$2000
3- $600 - $600 - $1200
4- $400 - $400 - $800
5- $200 - $200 - $400
6- $100 - $100 - $200
7- $50 - $50 - $100
8- $50 - $50 - $100

7 Card Razz
Tournament Stakes
Players-Ante-Limits

2- $2000-$2000-$4000
3- $1000-$1000-$2000
4- $500 - $500 - $1000
5- $300 - $300 - $600
6- $200 - $200 - $400
7- $100 - $100 - $200
8- $50 - $50 - $100

7 Card Hi/Low
Single Stakes
Players-Ante-Limits

2- $500 - $500 - $1000
3- $300 - $300 - $600
4- $200 - $200 - $400
5- $100 - $100 - $200
6- $50 - $50 - $100
7- $25 - $25 - $50
8- $25 - $25 - $50

Omaha
Double Stakes
Players-Blind-Limits

2- $1000-$1000-$2000
3- $600 - $600 - $1200
4- $400 - $400 - $800
5- $200 - $200 - $400
6- $100 - $100 - $200
7- $50 - $50 - $100
8- $50 - $50 - $100
9 -$25 - $25 - $50
10-$25 - $25 - $50

Omaha
Tournament Stakes
Players-Blind-Limits

2- $2000-$2000-$4000
3- $1000-$1000-$2000
4- $500 - $500 - $1000
5- $300 - $300 - $600
6- $200 - $200 - $400
7- $100 - $100 - $200
8- $100 - $100 - $200
9- $50 - $50 - $100
10-$50 - $50 - $100

7 Card Hi/Low
Double Stakes
Players-Ante-Limits

2- $1000-$1000-$2000
3- $600 - $600 - $1200
4- $400 - $400 - $800
5- $200 - $200 - $400
6- $100 - $100 - $200
7- $50 - $50 - $100
8- $50 - $50 - $100

7 Card Hi/Low
Tournament Stakes
Players-Ante-Limits

2- $2000-$2000-$4000
3- $1000-$1000-$2000
4- $500 - $500 - $1000
5- $300 - $300 - $600
6- $200 - $200 - $400
7- $100 - $100 - $200
8- $50 - $50 - $100

Hold'em
Single Stakes
Players-Blind-Limits

2- $500 - $500 - $1000
3- $300 - $300 - $600
4- $200 - $200 - $400
5- $100 - $100 - $200
6- $50 - $50 - $100
7- $25 - $25 - $50
8- $25 - $25 - $50
9- $25 - $25 - $50
10-$25 - $25 - $50

Hold'em
Double Stakes
Players-Blind-Limits

2- $1000-$1000-$2000
3- $600 - $600 - $1200
4- $400 - $400 - $800
5- $200 - $200 - $400
6- $100 - $100 - $200
7- $50 - $50 - $100
8- $50 - $50 - $100
9- $25 - $25 - $50
10-$25 - $25 - $50

Hold'em
Tournament Stakes
Players-Blind-Limits

2- $2000-$2000-$4000
3- $1000-$1000-$2000
4- $500 - $500 - $1000
5- $300 - $300 - $600
6- $200 - $200 - $400
7- $100 - $100 - $200
8- $100 - $100 - $200
9- $50 - $50 - $100
10-$50 - $50 - $100

Omaha
Single Stakes
Players-Blind-Limits

2- $500 - $500 - $1000
3- $300 - $300 - $600
4- $200 - $200 - $400
5- $100 - $100 - $200
6- $50 - $50 - $100
7- $25 - $25 - $50
8- $25 - $25 - $50
9- $25 - $25 - $50
10-$25 - $25 - $50

Fig. 2a

| 5 Card Draw High<br>Single Stakes<br>Players-Ante-Limits | 5 Card Stud<br>Single Stakes<br>Players-Ante-Limits | 5 Card Stud<br>Double Stakes<br>Players-Ante-Limits | 5 Card Stud<br>Tournament Stakes<br>Players-Ante-Limits | 7 Card Stud<br>Single Stakes<br>Players-Ante-Limits | 7 Card Stud<br>Double Stakes<br>Players-Ante-Limits |
|---|---|---|---|---|---|
| 2- $500 - $500 - $1000 | 2- $500 - $500 - $1000 | 2- $1000-$1000-$2000 | 2- $2000-$2000-$4000 | 2- $500 - $500 - $1000 | 2- $1000-$1000-$2000 |
| 3- $300 - $300 - $600 | 3- $300 - $300 - $600 | 3- $600 - $600 - $1200 | 3- $1000-$1000-$2000 | 3- $300 - $300 - $600 | 3- $600 - $600 - $1200 |
| 4- $200 - $200 - $400 | 4- $200 - $200 - $400 | 4- $400 - $400 - $800 | 4- $500 - $500 - $1000 | 4- $200 - $200 - $400 | 4- $400 - $400 - $800 |
| 5- $100 - $100 - $200 | 5- $100 - $100 - $200 | 5- $200 - $200 - $400 | 5- $300 - $300 - $600 | 5- $100 - $100 - $200 | 5- $200 - $200 - $400 |
| 6- $50 - $50 - $100 | 6- $50 - $50 - $100 | 6- $100 - $100 - $200 | 6- $200 - $200 - $400 | 6- $50 - $50 - $100 | 6- $100 - $100 - $200 |
| 7- $25 - $25 - $50 | 7- $25 - $25 - $50 | 7- $50 - $50 - $100 | 7- $100 - $100 - $200 | 7- $25 - $25 - $50 | 7- $50 - $50 - $100 |
| 8- $25 - $25 - $50 | 8- $25 - $25 - $50 | 8- $50 - $50 - $100 | 8- $50 - $50 - $100 | 8- $25 - $25 - $50 | 8- $50 - $50 - $100 |

| 5 Card Draw High<br>Double Stakes<br>Players-Ante-Limits | 5 Card Draw High<br>Tournament Stakes<br>Players-Ante-Limits | 5 Card Draw Low<br>Single Stakes<br>Players-Ante-Limits | 5 Card Draw Low<br>Double Stakes<br>Players-Ante-Limits | 5 Card Draw Low<br>Tournament Stakes<br>Players-Ante-Limits | 7 Card Stud<br>Tournament Stakes<br>Players-Ante-Limits |
|---|---|---|---|---|---|
| 2- $1000-$1000-$2000 | 2- $2000-$2000-$4000 | 2- $500 - $500 - $1000 | 2- $1000-$1000-$2000 | 2- $2000-$2000-$4000 | 2- $2000-$2000-$4000 |
| 3- $600 - $600 - $1200 | 3- $1000-$1000-$2000 | 3- $300 - $300 - $600 | 3- $600 - $600 - $1200 | 3- $1000-$1000-$2000 | 3- $1000-$1000-$2000 |
| 4- $400 - $400 - $800 | 4- $500 - $500 - $1000 | 4- $200 - $200 - $400 | 4- $400 - $400 - $800 | 4- $500 - $500 - $1000 | 4- $500 - $500 - $1000 |
| 5- $200 - $200 - $400 | 5- $300 - $300 - $600 | 5- $100 - $100 - $200 | 5- $200 - $200 - $400 | 5- $300 - $300 - $600 | 5- $300 - $300 - $600 |
| 6- $100 - $100 - $200 | 6- $200 - $200 - $400 | 6- $50 - $50 - $100 | 6- $100 - $100 - $200 | 6- $200 - $200 - $400 | 6- $200 - $200 - $400 |
| 7- $50 - $50 - $100 | 7- $100 - $100 - $200 | 7- $25 - $25 - $50 | 7- $50 - $50 - $100 | 7- $100 - $100 - $200 | 7- $100 - $100 - $200 |
| 8- $50 - $50 - $100 | 8- $50 - $50 - $100 | 8- $25 - $25 - $50 | 8- $50 - $50 - $100 | 8- $50 - $50 - $100 | 8- $50 - $50 - $100 |

Fig. 2b

| Banks<br>Single Stakes<br>Players Limits | Straight<br>Single Stakes<br>Players -Limits | Straight<br>Double Stakes<br>Players - Limits | Straight<br>Tournament Stakes<br>Players - Limits | Trick Shot<br>Single Stakes<br>Players - Limits | Trick Shot<br>Double Stakes<br>Players - Limits |
|---|---|---|---|---|---|
| 2- $5,000 | 2- $5,000 | 2- $10,000 | 2- $15,000 | 2- $5,000 | 2- $10,000 |
| 3- $4,000 | 3- $4,000 | 3- $8,000 | 3- $12,500 | 3- $4,000 | 3- $8,000 |
| 4- $3,000 | 4- $3,000 | 4- $6,000 | 4- $10,000 | 4- $3,000 | 4- $6,000 |
| 5- $2,000 | 5- $2,000 | 5- $4,000 | 5- $7,500 | 5- $2,000 | 5- $4,000 |
| 6- $1,500 | 6- $1,500 | 6- $3,000 | 6- $5,000 | 6- $1,500 | 6- $3,000 |
| 7- $1,000 | 7- $1,000 | 7- $2,000 | 7- $3,000 | 7- $1,000 | 7- $2,000 |
| 8- $ 500 | 8- $ 500 | 8- $1,000 | 8- $2,000 | 8- $ 500 | 8- $1,000 |

| Banks<br>Double Stakes<br>Players - Limits | Banks<br>Tournament Stakes<br>Players - Limits | One Pocket<br>Single Stakes<br>Player - Limits | One Pocket<br>Double Stakes<br>Players - Limits | One Pocket<br>Tournament Stakes<br>Players - Limits | Trick Shot<br>Tournament Stakes<br>Players - Limits |
|---|---|---|---|---|---|
| 2- $10,000 | 2- $15,000 | 2- $5,000 | 2- $10,000 | 2- $15,000 | 2- $15,000 |
| 3- $8,000 | 3- $12,500 | 3- $4,000 | 3- $8,000 | 3- $12,500 | 3- $12,500 |
| 4- $6,000 | 4- $10,000 | 4- $3,000 | 4- $6,000 | 4- $10,000 | 4- $10,000 |
| 5- $4,000 | 5- $7,500 | 5- $2,000 | 5- $4,000 | 5- $7,500 | 5- $7,500 |
| 6- $3,000 | 6- $5,000 | 6- $1,500 | 6- $3,000 | 6- $5,000 | 6- $5,000 |
| 7- $2,000 | 7- $3,000 | 7- $1,000 | 7- $2,000 | 7- $3,000 | 7- $3,000 |
| 8- $1,000 | 8- $2,000 | 8- $ 500 | 8- $1,000 | 8- $2,000 | 8- $2,000 |

Fig. 3a

| 6 Ball Single Stakes Players Limits | 8 Ball Single Stakes Players -Limits | 8 Ball Double Stakes Players - Limits | 8 Ball Tournament Stakes Players - Limits | 15 Ball Single Stakes Players - Limits | 15 Ball Double Stakes Players - Limits |
|---|---|---|---|---|---|
| 2- $5,000 | 2- $5,000 | 2- $10,000 | 2- $15,000 | 2- $5,000 | 2- $10,000 |
| 3- $4,000 | 3- $4,000 | 3- $8,000 | 3- $12,500 | 3- $4,000 | 3- $8,000 |
| 4- $3,000 | 4- $3,000 | 4- $6,000 | 4- $10,000 | 4- $3,000 | 4- $6,000 |
| 5- $2,000 | 5- $2,000 | 5- $4,000 | 5- $7,500 | 5- $2,000 | 5- $4,000 |
| 6- $1,500 | 6- $1,500 | 6- $3,000 | 6- $5,000 | 6- $1,500 | 6- $3,000 |
| 7- $1,000 | 7- $1,000 | 7- $2,000 | 7- $3,000 | 7- $1,000 | 7- $2,000 |
| 8- $ 500 | 8- $ 500 | 8- $1,000 | 8- $2,000 | 8- $ 500 | 8- $1,000 |

| 6 Ball Double Stakes Players - Limits | 6 Ball Tournament Stakes Players - Limits | 9 Ball Single Stakes Player - Limits | 9 Ball Double Stakes Players - Limits | 9 Ball Tournament Stakes Players - Limits | 15 Ball Tournament Stakes Players - Limits |
|---|---|---|---|---|---|
| 2- $10,000 | 2- $15,000 | 2- $5,000 | 2- $10,000 | 2- $15,000 | 2- $15,000 |
| 3- $8,000 | 3- $12,500 | 3- $4,000 | 3- $8,000 | 3- $12,500 | 3- $12,500 |
| 4- $6,000 | 4- $10,000 | 4- $3,000 | 4- $6,000 | 4- $10,000 | 4- $10,000 |
| 5- $4,000 | 5- $7,500 | 5- $2,000 | 5- $4,000 | 5- $7,500 | 5- $7,500 |
| 6- $3,000 | 6- $5,000 | 6- $1,500 | 6- $3,000 | 6- $5,000 | 6- $5,000 |
| 7- $2,000 | 7- $3,000 | 7- $1,000 | 7- $2,000 | 7- $3,000 | 7- $3,000 |
| | 8- $2,000 | 8- $ 500 | 8- $1,000 | 8- $2,000 | 8- $2,000 |

Fig. 3b $1000
Collect Bankroll $25
Collect Each Player $250
Collect Bankroll $50
Collect Each Player $500
Collect Bankroll $75
Collect Each Player $50
Collect Bankroll $100
Collect Each Player $100
Collect Bankroll $125
Collect Each Player $750
Collect Bankroll $150
Collect Each Player

Fig. 5a

METHOD FOR PLAYING A BOARD GAME

This is a continuation of Ser. No. 07/587,868, filed Oct. 12, 1990, now abandoned.

BACKGROUND OF THE INVENTION

The games of poker and pocket billiards have been played by people all over the world for hundreds of years. These traditional family entertainment games of skill are so well known by our culture that it is certain that at some time in your life you will be afforded the chance to play in a poker or pocket billiard game.

Yet, until this invention no person has ever played these two games in conjunction with the playing surface of a board game. Using a board game to play poker and pocket billiards requires a new method of playing that is unique to the traditional poker and pocket billiard games played, but it is a method of playing a board game that does not alter the rules of play for playing a particular poker or pocket billiard game.

The method of this invention enhances the thrill of competing, chance of winning and degree of skill needed to win an ordinary poker or pocket billiard game. This board game playing method is unique in the way it directs the players on what poker or pocket billiard game to play during the board game, and for how much money each of these games will be played for during the board game based on the number of players competing in the game.

The board games disclosed in the prior art also have methods that include the use of other games of skill in conjunction with the playing surface of the board game, but there is not any board game which selects the games to be played, and the limits the games are to be played for based on the method of play described herein this specification.

For example, the U.S. Pat. No. 4,887,819 to Walker discloses a board game involving the use of casino games to determine the movement of the playing piece, and the odds of payoff at which each player can wager for depending on the space he has landed. However, this game does not use a plurality of drawing cards with indicia imprinted on each to select which game to play, and then directing the players what limits of wager to compete for based on the number of players competing in the board game.

SUMMARY OF THE INVENTION

It is an object of this invention to provide a board game which will enhance the playing of traditional family entertainment card or pocket billiard games. Another object of this invention is to provide a board game that can use an unlimited number of card or pocket billiard games in conjunction with the board game playing method.

Still another object of this invention is to provide a board game where the limits the traditional card and pocket billiard games are played for are determined by the number of players still remaining in the game.

And another object of this invention is to provide a board game that uses three sets of draw cards to determine what penalties, bonuses and games the board game is played for depending on the spaces a player lands on during the course of play.

And it is the object of this invention to provide a board game that has four playing spaces of Win Jackpot, High Card, Low Card and Over/Under that have no degree of skill in determining the outcome of the play. These spaces use the luck of the roll of the dice, or the cut of the cards to decide if and how much is won on that play.

A game board is provided where there are 24 spaces put in a circle around the outside edge playing path of the game board that a player can land on to determine the next play of the game. Inside the outer ring of spaces the inner game board is sectioned into four separate sections where each have a different function to perform during the play of the game. These four sections include a jackpot section, a bankroll section, a draw card section and a playing cards section. These sections are designed to house the components of the game.

A player must first throw two dice to determine how many spaces to move on the game board before landing on the space where the player must act according to the instructions of play for that space on the game board. This board game has only one moving piece. This moving piece does not travel along the board on a path of spaces from start to finish to determine the winner. Rather, the moving piece can travel in either direction around the spaces on the game board. The winner of the game is determined by the money, not by what space the player has finally landed on. The moving piece travels around the game board until only one player remains in the game with all the money. After players are seated, they decide which set of game draw cards to use, either cards or pocket billiards and the game begins.

During the play of the game a player may land on a pay, collect or game draw card space. The player than draws the correct card, and acts according to the instructions on the card. Every time a player lands on a pay space he draws a pay card. He then pays the amount on the card to the jackpot section, bankroll section, ante section or other players in the game. If he draws a collect card the player than collects money from the jackpot section, bankroll section or other players in the game according to the instructions on the card. And if the player draws a game card for landing on a game space he must instruct the other players on which game to play, what stakes to play for, what antes to make and what limits to play depending on the number of players still in the game.

The game has $100,000.00 in total game money. This money is rationed out at the beginning to the players depending on the number of players from two to ten that start the game. Once a player loses his starting bankroll he is eliminated from the game. To win a player must accumulate all $100,000.00 in the game.

BRIEF DESCRIPTION OF THE DRAWINGS

FIG. 1*b* is a view of the combination of game parts including two dice, one board marker, three stacks of draw cards, one standard playing deck and billiard balls.

FIG. 2*a* and 2*b* is a view of the game draw cards used for the method of playing card games.

FIG. 3*a* and 3*b* is a view of the game draw cards used for the method of playing pock et billiard games.

FIG. 5*a* and 5*b* is a view of the method on the collect draw cards used in this invention.

PREFERRED EMBODIMENTS OF THE INVENTION

Figure 1:
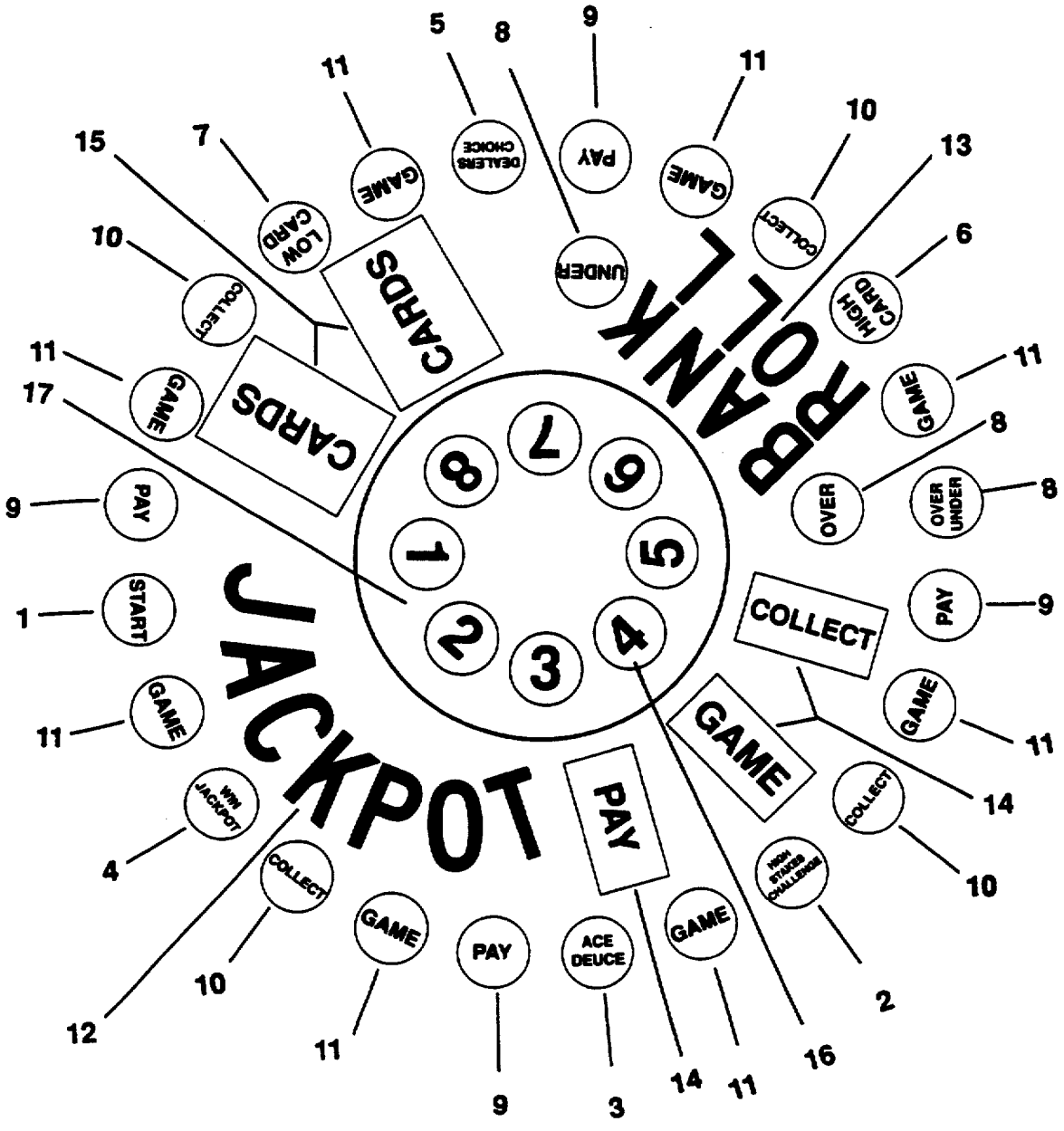
FIG. 1 is a drawing of the playing surface layout of the game board used by this invention.
Figure 4A:
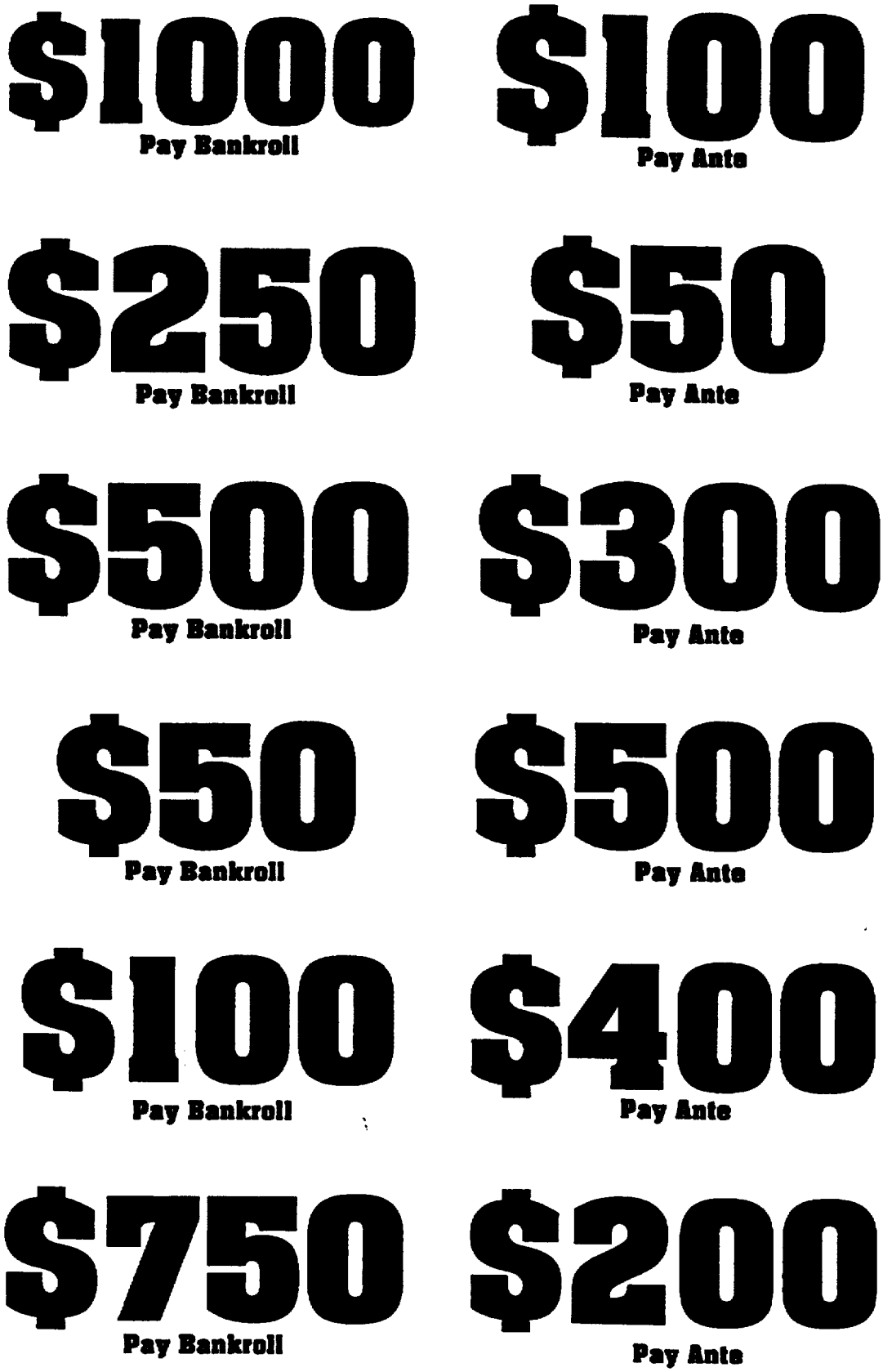
FIG. 4*a* and 4*b* is a view of the method on the pay draw cards for this invention.
Figure 4B:
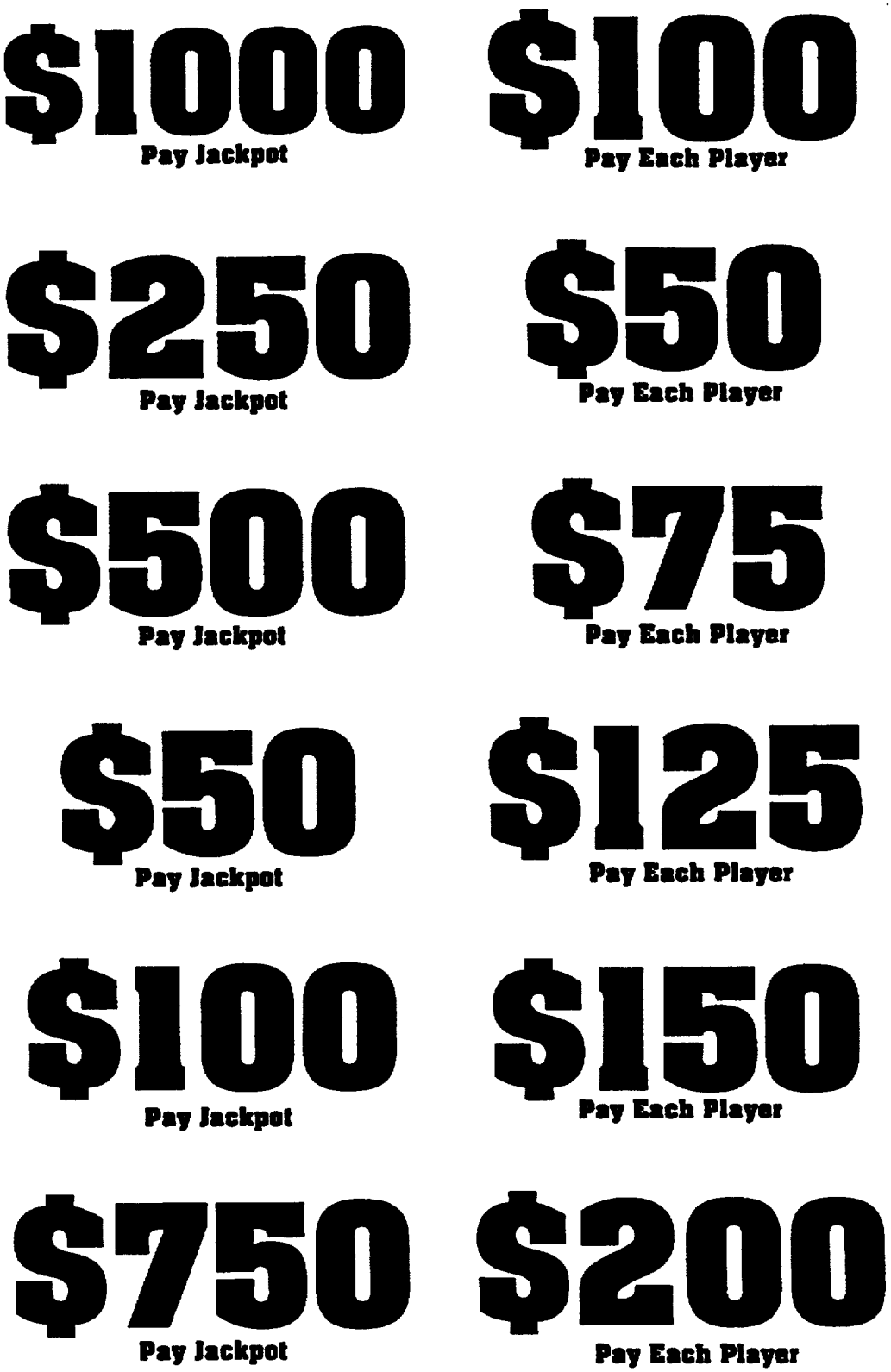
Figure 5B:
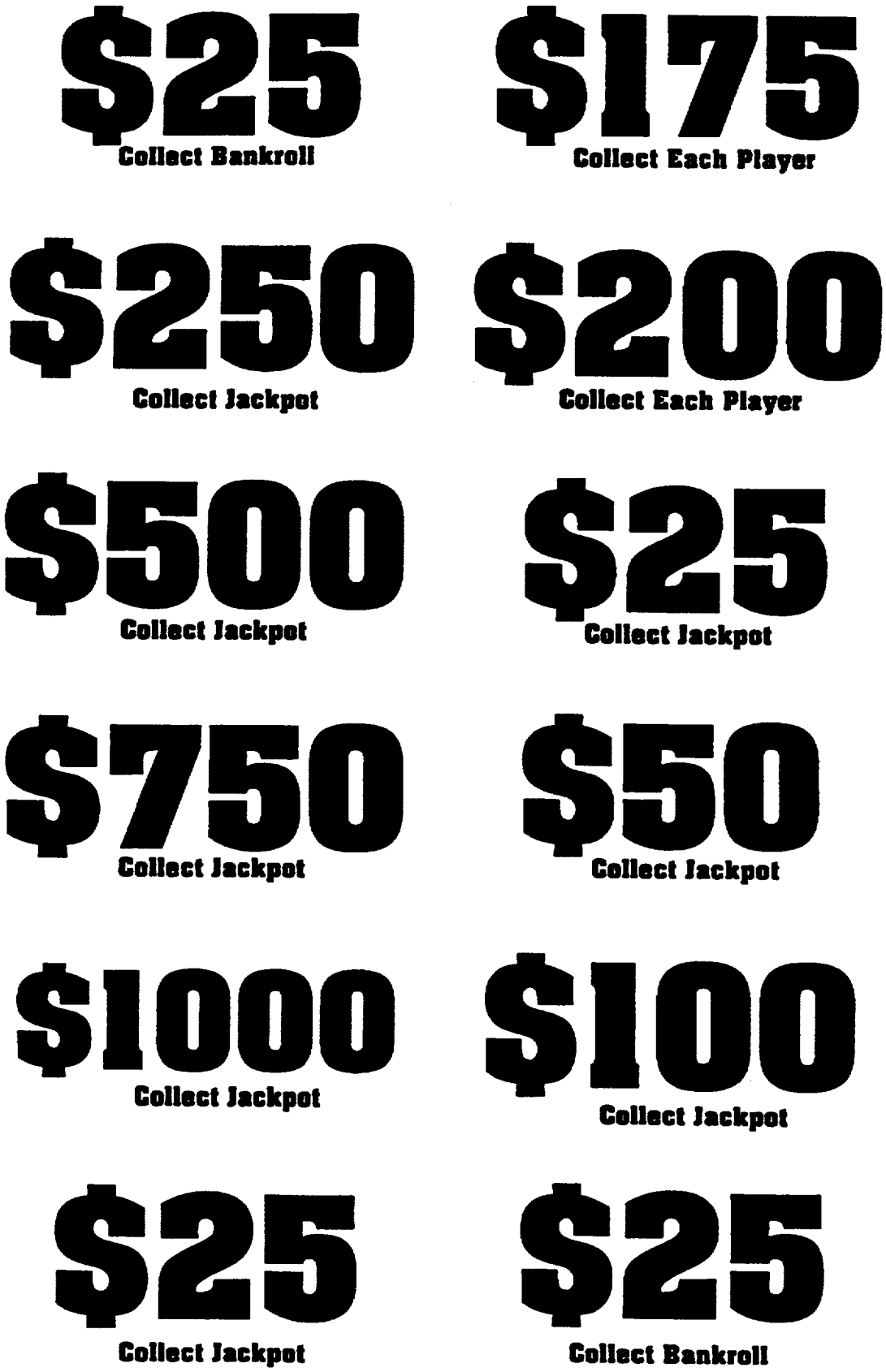
Figure 6:
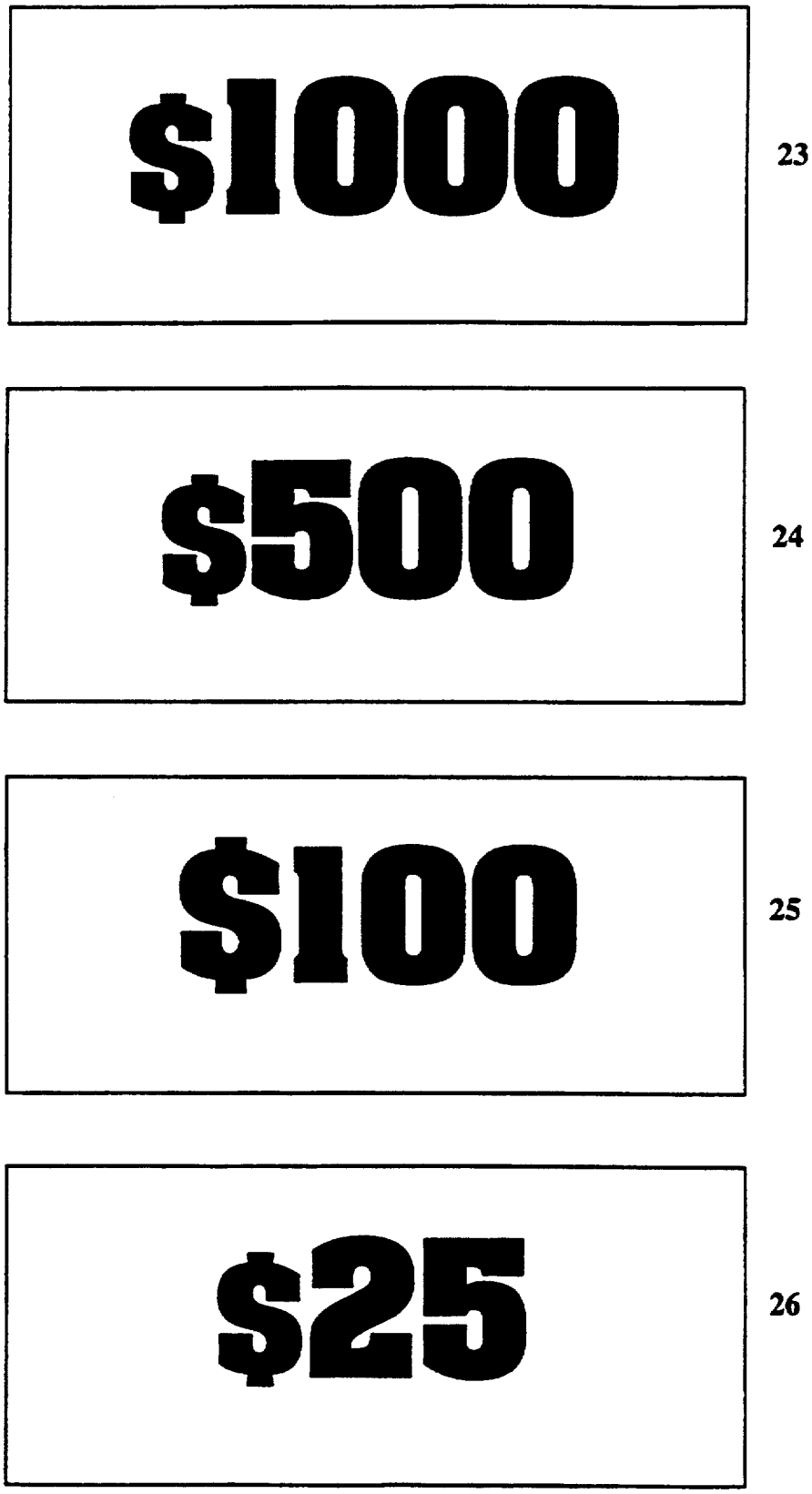
FIG. 6 is a view of the four money denominations used in this invention.
Figure 7:
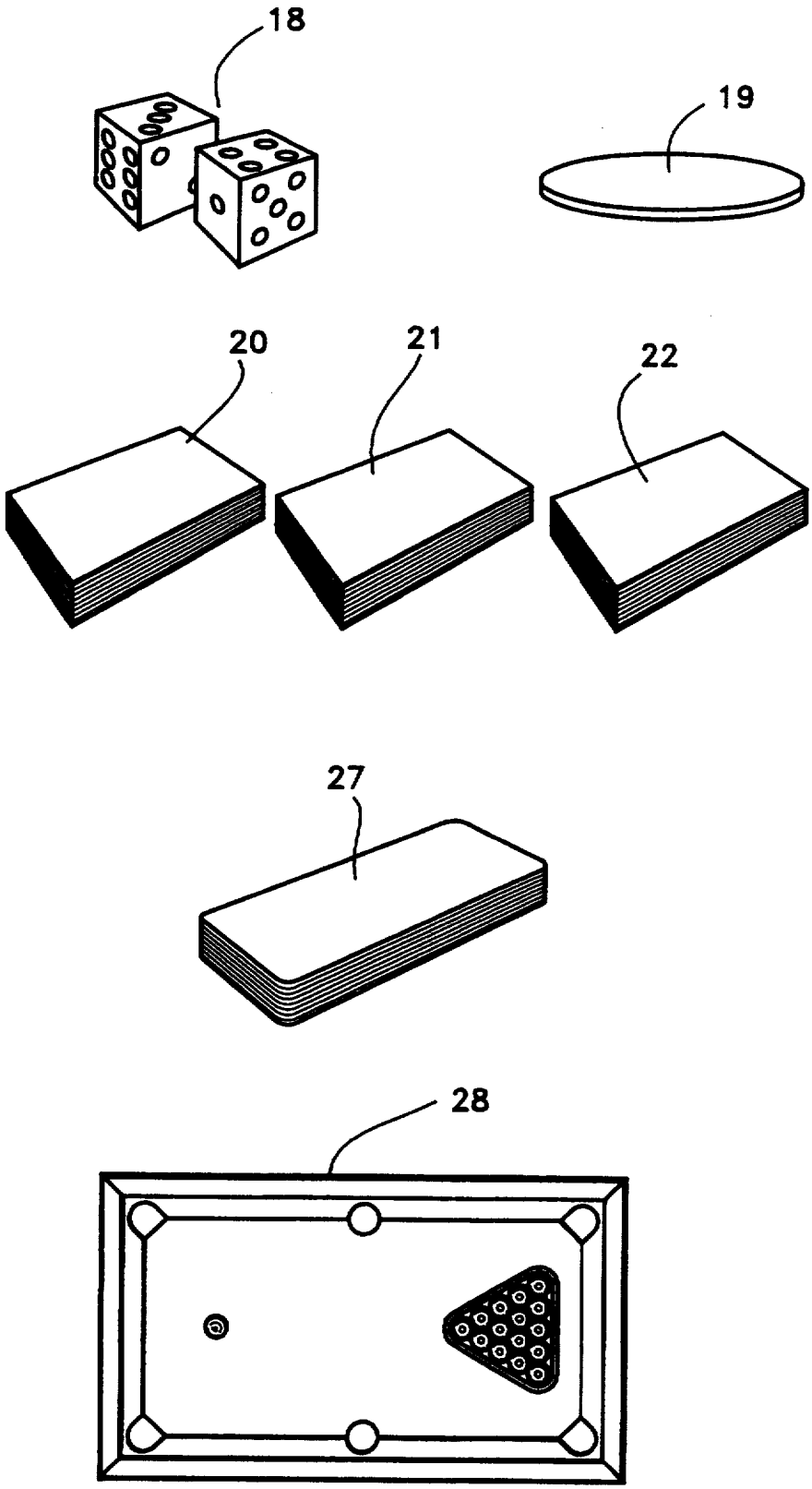
FIG. 7 is a view of the game parts including two dice, one board marker, three stacks of draw cards, one standard playing deck and a six pocket billiard table with billiard balls.

In FIG. 1 the board game playing surface is marked for the play of the game. The playing surface is provided with a center dice circle 17 where the two game dice 18 are placed after each player's turn is taken. Outside the dice circle 17 is the ante circle 16 where seven spaces are provided for players to place the antes prior to the start of each card or pocket pool game. Outside the ante circle 16 are four separate but equal sections of the game board that enhance the play of the game. The cards section 15 provides two spaces where the two standard 52 card playing decks are used, one at a time for the card playing method of this invention are placed after each players turn. The jackpot section 12 provides a place where players can pay penalties and collect bonuses during the play of the game. The draw card section 14 provides a place on the game board where players can draw a card to find out the next play of the game. The player drawing will either pay 21 a penalty, collect 22 a bonus or play the game listed on the game card 20 for playing card or pocket billiard games.

The bankroll section 13 provides a place where players can either pay 21 penalties, collect 22 bonuses or use the over/under wager 8. Outside of the four equal sections for playing the game are 24 spaces that form the playing path of the game. The start space 1 provides a space where the moving piece 19 is placed to begin the game. The game begins clockwise, until start is landed on to reverse direction of play to counter-clockwise on the playing path. The high stakes challenge space 2 provides a space where the player landing there must challenge the player with the most game money 23-26 to a one-on-one card or pocket billiard game. The ace/-deuce space 3 provides a space where the player landing there deals a card game of ace/deuce to all the players in the game. The win jackpot space 4 provides a space where the player landing there can roll the dice to determine how much of a bonus he receives from the jackpot section 12 based on the number of the dice 18 rolled. The dealer choice space 5 provides a space where the player landing there can decide to play any card or pocket billiard game he desires including games only listed in the game method on the game 20 cards. The high card space 6 provides a space where the player landing there shuffles the cards 27 and then offers them for a high card cut to all the players in the game. The low card space 7 provides a space where the player landing there shuffles the cards 27 and then offers them for a low card cut to all the players in the game. The over/under space 8 provides a space where a player landing there can place an over/under wager that he can cut the cards 27 over or under the number eight card in the deck.

He places his wager on the over or under spaces 8 in the bankroll section 13 either winning or losing the amount wagers to the bankroll section 13. On the playing surface there are four pay spaces 9. These spaces are located one in each of the four equal sections. This space provides a method where the player landing there must draw a pay card 21, and pay the penalty listed on the card. Also on the playing path of spaces are four collect spaces 10. There are divided one in each of the four equal playing sections. This space provides a space where the player landing there must draw a collect card 22. That player must then collect the bonus listed on the card. And finally there are eight game spaces 11. There are two game spaces in each of the four playing sections on the playing path. The game space 11 provides a space where the player landing there must draw a game card 11. The player must then play the game 11 list ed on the card for either cards 27 or pocket billiards 28.

This invention can be played with two up to ten players. At least two dice 18, one standard 52 card playing deck 27, or one 15 ball pocket billiard table are used in conjunction with the game board and game pieces. The players compete against themselves in a money elimination format until only one player remains in the game with all the money won.

The game begins with the players deciding which game cards to use either cards or pocket billiards. Then each player 8 is given his starting bankroll according to the number of players beginning the game as listed in chart 28 for game money distribution. Each starting player then rolls the dice one time, and they are then seated at the table in the order of dice thrown from highest first to lowest number being seated last. The player who was seated first will roll the dice 18 to begin the game. He then moves the moving piece 19 the correct number of spaces clockwise around the playing path landing on the correct number thrown. The player then acts according to the rules for the space he has landed on the playing path. He must follow the correct steps of play for each space.

If the player lands on a high stake challenge space 2 he must challenge the player in the game with the most money to a head up one-on-one match play game of cards 27 or pocket billiards 28. The player draws a game card 20 to see which game will be played. All match play contests are played for two player limits at the tournament stakes level on the game card drawn. Once the match play is over, and one player has won the match, the dice 17 are returned to the next player and the game continues. He rolls the dice and moves the correct number of spaces.

If the player lands on the ace/deuce space 3 he shuffles the cards 27 and deals a game of ace/deuce 3 to all the players in the game. Dealing clockwise he deals one at a time two cards 27 face up to each player in the game. Starting with the next player to his left each player can wager against the money in the jackpot section 16 up to 50 percent of his own bankroll that he will draw one card, and that card will be directly in middle of the two up cards he already has in front of him. If he draws one card in the middle he wins the amount bet. If he draws outside or even ties the two up cards he has on his one card draw he losses the amount bet to the jackpot section 12. This continues until each player in the game has had one chance in order from left to right with the dealer going last to either pass or wager on the one card draw. The dice 18 are then passed to the left to the next player and the game continues.

If the player lands on a win jackpot space 4 he rolls the dice 18 one time to determine how much money he wins from the jackpot section 12. If the player rolls a two or twelve on the dice 18 he receives 50 percent of the total money in the jackpot section 12. A three or eleven rolled gets 40 percent, a four or ten gets 30 percent, a five or nine gets 20 percent, a six or eight gets 10 percent, and a seven rolled earns 5 percent of the total money in the jackpot section 12. The dice are then passed to the next player on the left and the game continues.

If the player lands on the dealer choice space 5 he shuffles the cards 27 and deals whatever game he wishes to play, or plays whatever pocket billiard game he wishes to play. The game must be chosen from one of the games listed on the game cards. The game is played for tournament stakes and the limits are determined by the correct number of players still in the game using the game card limits listed. Once a winner is determined the dice 18 are passed to the next player and the game continues.

If the player lands on a high card space 6 he then shuffles the cards 27, and offers them for a cut to all players. The player that cuts the highest card from the deck is the -winner. If two players tie for the high card they draw again until only one player has cut the highest card from the deck. The mount each player plays for in the high card cut is determined by the number of players still in the game. Players all ante $500.00 each for seven or more players, $1,000.00 each for six players cutting, $1,500.00 for five players, $2,000.00 for four players, $3,000.00 for three players and $6,000.00 anted for the high card cut with only two players still in the game.

If the player lands on a low card space 7 he must shuffle the cards and offer them to all the players for a low card cut from the deck. The player that cuts the lowest card wins the money anted. If there is a tie for the low card, the players that tied will cut again until only one player has the lowest card. Depending on the number of players remaining in the game the low card cut is played for $500.00 with seven or more players, $1,000.00 for six players, $1,500.00 for five players, $2,000.00 for four players, $3,000.00 for three players and $6,000.00 for two players in the game cutting the cards.

If the player lands on an over/under space 8 he must then wager on whether he can cut the cards 27 one time over or under the number eight card in the deck. He places his wager on the over or under space 8 in the bankroll section 13. He cannot wager more than 50 percent of the money he has left in the game. If he draws a number eight card it is a tie, and his money bet is returned to him. He wins the wager from the bankroll section 13 if he bets over and he draws over the number eight, or if he bets under and he draws under the number eight. He loses his wager to the bankroll section 13 if he bets over and he draws under the number eight, or if he bets under and he draws over the number eight. It is an even money bet with no odds involved.

If the player lands on a pay space 9 he must draw a pay card 21. That player must then pay the mount on the card. And he must pay it to the person or section listed on the pay card 21. The player will be directed by the pay card 21 to pay the amount listed to either the remaining players in the game, the ante section 16, the jackpot section 12 or the bankroll section 13.

If the player lands on a collect space 10 he must draw a collect card 22. That player must then collect the mount listed on the collect card 22 from the players or the section listed on the card. The player then collects the amount listed from the players still remaining in the game, the bankroll section 13 or the jackpot section 12. Once this is completed the dice 18 are passed to the next player on the left and the game continues.

If the player lands on a game space 11 he must draw a game card 20. At the beginning of the game the players decide whether the game will be played for cards or pocket billiards. Then the correct game cards 20 will be placed in its space on the playing surface 14. Once a player draw a game card 20 he shuffles the cards 27 and deals, or he racks the pool balls 28 and breaks. All the players remaining in the game must play either cards or pocket billiards for the stakes and limits listed on the game card 20. For each game played there are three cards that list the single, double or tournament stakes for each card or pocket billiard game. And the limits played for are listed according to the number of players still remaining in the game. Once the game is played, and a winner is determined by showing the highest ranking card hand for that card game or by shooting in the winning pool ball for that pocket billiard game he is awarded the money played for. He then passes the dice to the next player on the left, and the game continues until only one players has all the money of the game.

The moving piece 19 continues around the playing path as many times as it takes until only one player remains in the game with all $100,000.00 in game money in front of him. Once a player losses his starting game money he is eliminated from the game. This directs the game card to signal the other players to play for higher limits because less players are still in the game. And the limits continue to get higher until only two players remain. Those two players play for the highest limits possible in the game until only one player has all the money, and the game is then over.

Examples of the possible methods for distributing the starting money based on the number of players starting the game shown in FIG. 1, are illustrated by the following table:

| PLAYERS STARTING | PLAYERS STARTING MONEY | BANKROLL SECTION STARTING MONEY | JACKPOT SECTION STARTING MONEY | GAMING MONEY |
|---|---|---|---|---|
| 10 | $9,000.00 | $5,000.00 | $5,000.00 | $100,000.00 |
| 9 | 10,000.00 | 5,000.00 | 5,000.00 | |
| 8 | 10,000.00 | 10,000.00 | 10,000.00 | |
| 7 | 10,000.00 | 15,000.00 | 15,000.00 | |
| 6 | 12,500.00 | 12,500.00 | 12,500.00 | |
| 5 | 15,000.00 | 12,500.00 | 12,500.00 | |
| 4 | 20,000.00 | 10,000.00 | 10,000.00 | |
| 3 | 25,000.00 | 12,500.00 | 12,500.00 | |
| 2 | 35,000.00 | 15,000.00 | 15,000.00 | |

Examples of the possible methods of receiving a bonus from the jackpot section when a player lands on a win/jackpot space. The percentage payout is based on the number the player rolls on the dice when he plays the game shown in FIG. 1, are illustrated by this table:

| NUMBER ROLLED | PERCENTAGE OF JACKPOT PAYOUT |
|---|---|
| 2 or 12 | 50 percent of total money |
| 3 or 11 | 40 percent |
| 4 or 10 | 30 percent |
| 5 or 9 | 20 percent |
| 6 or 8 | 10 percent |
| 7 | 5 percent |

The foregoing is illustrative only of the playing method of the invention. Further, because of the new method of play needed to make this game fun to play and win it is desired that all the new methods and ways of playing this invention be protected as to the ideas, intention and operation of the invention shown and described falling within the scope of the invention as claimed.

What is claimed is:

1. A method of playing a board game comprising the steps of:

(a) providing a game board having a plurality of spaces arranged in a continuous path and a marked starting space, a board marker, two six sided dice, wagering money, penalty cards, bonus cards, game selecting cards, played by a plurality of players, (b) a player distributing the wagering money to the starting players, (c) a player placing the board marker on the starting space, (d) providing a stack of pay draw cards and a pay section on the game board and placing the stack of pay cards on the pay section, (e) providing a stack of collect cards and a collect section on the game board and placing the stack of collect draw cards on the collect section, (f) providing a stack of poker game selecting draw cards and a stack of pocket billiard game selecting draw cards and a game section on the game board, (g) a player choosing either the poker stack of game selecting cards or the pocket billiard stack of game selecting cards and placing it on the game section of the game board, (h) providing two 52 card standard playing decks and a card section on the game board and a player placing the two decks on the card section of the game board, (i) a player distributing wagering money to a jackpot section and a bankroll section of the game board, (j) providing a plurality of second spaces on the game board designated as a ante circle section with each player placing an ante water on a designated ante space, (k) providing two six sided dice with numeric indicia imprinted on each side, a player rolling the dice and totaling the number of indicia displayed, (l) the player moving the board marker an equal number of spaces to the number displayed by the dice, (m) said plurality of continuous spaces provided with a space marked win-jackpot and a player landing on said space taking the action of rolling the two dice once and collecting money from the jackpot section equal to the number of the indicia displayed by the dice, (n) said plurality of continuous spaces provided with a space marked ace-duece and a player landing on said space taking the action of shuffling and dealing a standard 52 card playing deck and giving each player two cards face up in rotation so each player can wager on drawing one more cards from the deck, (o) said plurality of continuous spaces provided with a space marked high stakes challenge and a player landing on said space taking the action of selecting one draw card from the stack of game selecting cards and then challenging the player with the most wagering money in the game at that time to play against, (p) said plurality of continuous spaces provided with a space marked over-under and a player landing on said space taking the action of placing a wager on the over or the under section of the game board in the bankroll section and then having a player drawing one card from a standard 52 card playing deck either over or under the number eight card in the deck, (q) each player taking the action of placing an equal amount of wagering money on the jackpot section and on the bankroll section every tim the jackpot money or the bankroll money is depleted during the game, (r) said plurality of continuous spaces provided with a space marked high card and a player landing on said space taking the action of instructing all players to make a wager on the ante section of the game board and selecting one card each from the standard 52 card playing deck with the highest card selected winning the wagers, (s) said plurality of continuous spaces provided with a space marked dealer's choice and a player landing on said space taking the action of selecting by himself which game will be played by all the players without using the game selecting cards, (t) said plurality of continuous spaces provided with a space marked low card and a player landing on said space taking the action of instructing all players to make a wager on the ante section of the game board and selecting one card from a standard 52 card playing deck with the lowest card selected winning all the wagers, (u) said plurality of continuous spaces provided with a space marked start and a player landing on said space after a first rotation of the game path by the board marker taking the action of reversing the direction of the board marker until the start space is landed on again and reversing the rotation of the players turns at throwing the dice until the start space is landed on again, (v) said plurality of continuous spaces with a space marked pay and a player landing on said space taking the action of selecting one card from a stack of pay draw cards and paying a penalty to the other players in the game, (w) said plurality of continuous spaces provided with a space marked collect and a player landing on said space taking the action of selecting one card from the stack of collect draw cards and collecting a bonus from all the players in the game, (x) said plurality of continuous spaces provided with a space marked game and a player landing on said space taking the action of selecting one card from a stack of game draw cards and shuffling and dealing a standard 52 card playing deck to the other players or racking 15 pocket billiard balls on a six pocket billiard table for the other players to compete and play the game drawn on the game card, (y) providing game draw cards with indicia imprinted on them that instructs the players what wagering limits to use when a game card is drawn by a player, (z) ending the game when all but one player has lost all of this wagering money.

2. A board game playing method as claimed in claim 1 wherein the step of drawing a game selecting card provides for a secondary wagering game that uses a standard six pocket billiard table with one cue ball and 15 pocket billiard balls ranked from high to low 15,14,13,12,11,10,9,8,7,6,5,4,3,2,1.

3. A board game playing method as claimed in claim 1 wherein the step of drawing a game selecting card provides for a secondary wagering game that uses the pocket billiard games of 15 ball, 9 ball, 8 ball, 6 ball, one pocket, banks, rotation, and trick shots.

4. A board game playing method as claimed in claim 1 wherein the step of drawing a game selecting card provides for a secondary wagering game that uses a standard 52 card playing deck ranked from high to low ace, king, queen, jack, 10,9,8,7,6,5,4,3,2.

5. A board game playing method as claimed in claim 1 wherein the step of drawing a game selecting card provides for a secondary wagering game that uses the card games of seven card stud, seven card razz, seven card high-low, five card stud, five card draw high, five carddraw low, omaha and hold'em.

6. A board game playing method as claimed in claim 1 wherein the step of drawing a game selecting card further includes a wagering selecting means provided by a game selecting card with indicia imprinted on it that sets the wagering limits of the game to be played based on the total number of players starting the game and raises the wagering limits of the game to be played every time a player is eliminated from the board game.

7. A board game playing method as claimed in claim 1 wherein the step of providing a stack of game draw cards further includes a game selecting means wherein said stack of game draw cards have interchangeable stacks of game draw cards that allow for a plurality of secondary wagering games by changing the stack of game draw cards on the game section of the game board.

8. A board game as claimed in claim 1 wherein the step of landing on a over-under space further includes a over-under wagering means wherein a player wins a wager if the player wagers on the over section of the game board and selects a card from the standard 52 card playing deck over the number eight card in the deck and wins a wager if the player wagers on the under section of the game board and selects a card from the standard 52 card playing deck under the number eight card in the deck with the players wager being returned if the number eight card is selected from the 52 card playing deck.

* * * * *

UNITED STATES PATENT AND TRADEMARK OFFICE

CERTIFICATE OF CORRECTION

PATENT NO. : 5,372,366

DATED : 12/13/94

INVENTOR(S) : James M. Gohlke

It is certified that error appears in the above-indentified patent and that said Letters Patent is hereby corrected as shown below:

Column 2, lines 55, 56, 57 and 58, delete "FIG. 1b is a view of the combination of game parts including two dice, one board marker, three stacks of draw cards, one standard playing deck and billiard balls.".

Column 2, line 62, "playing pock et billiard" should read --playing pocket billiard--.

Column 4, line 9, "game 11 list ed" should read --game 11 listed--.

Column 5, line 17, "the - winner" should read --the winner--.

Column 5, line 19, "The mount each" should read --The amount each--.

Column 5, line 55, "the mount on" should read --the amount on--.

Column 5, line 63, "mount listed" should read --amount listed--.

Column 8, line 11, "every tim the" should read --every time the--.

Column 9, line 18, "carddraw low" should read --card draw low--.

Column 3, line 13, "seven spaces" should read --eight spaces--.

Column 3, line 19, "invention are" should read --invention, are--.

Column 2, line 32, "player than" should read --player then--.

Column 2, line 38, "player than collects" should read --player then collects--.

Column 3, line 63, "amount wagers to" should read amount wagered to--.

Column 4, line 13, "or one 15 ball pocket" should read --or one fifteen ball pocket--.

Column 4, line 22, "chart 28 for" should read --chart for--.

UNITED STATES PATENT AND TRADEMARK OFFICE

CERTIFICATE OF CORRECTION

PATENT NO. : 5,372,366

DATED : 12/13/94

INVENTOR(S) : James M. Ghlke

It is certified that error appears in the above-indentified patent and that said Letters Patent is hereby corrected as shown below:

Column 4, line 51, "in middle" should read --in the middle--.

In the drawings, sheet 4 of 11, Fig. 3a, the word "Straight" should read --Rotation--; and on the draw card for the game of ONE POCKET, SINGLE STAKES, the line of text for 6 players has a space that needs to be deleted so that the entire line of text can be justified one space to the left.

Signed and Sealed this

Ninth Day of May, 1995

*Attest:*

Bruce Lehman

BRUCE LEHMAN

*Attesting Officer*

*Commissioner of Patents and Trademarks*